United States Patent [19]

Dreisziger et al.

[11] 3,977,205

[45] Aug. 31, 1976

[54] REFRIGERANT MASS FLOW CONTROL AT LOW AMBIENT TEMPERATURES

[75] Inventors: Adam A. Dreisziger, Coraopolis; Ralph R. Kirsch, Wexford, both of Pa.

[73] Assignee: Dravo Corporation, Pittsburgh, Pa.

[22] Filed: Mar. 7, 1975

[21] Appl. No.: 556,297

[52] U.S. Cl. ..... 62/117; 62/504; 62/525

[51] Int. Cl.[2] ..... F25B 5/00; F25B 39/02

[58] Field of Search ..... 62/117, 504, 525, 197

[56] References Cited

UNITED STATES PATENTS

| | | | |
|---|---|---|---|
| 2,053,945 | 9/1936 | Cowin | 62/117 |
| 2,332,981 | 10/1943 | Anderson | 62/525 |
| 3,371,500 | 3/1968 | Marcus, Jr. | 62/117 |
| 3,563,055 | 2/1971 | Owens | 62/504 |
| 3,866,439 | 2/1975 | Bussjager et al. | 62/504 |

*Primary Examiner*—Lloyd L. King
*Attorney, Agent, or Firm*—Parmelee, Miller, Welsh & Kratz

[57] ABSTRACT

This invention relates to a refrigeration system having an air-cooled condenser and more particularly to maintaining an adequate mass flow of refrigerant to the evaporator at low high-side pressures resulting from low ambient temperatures, by providing a dual refrigerant distributor system, refrigerant being metered through only one distributor when the high-side pressure is at or above a predetermined level and refrigerant being metered through both distributors when the high-side pressure drops below the predetermined level.

6 Claims, 1 Drawing Figure

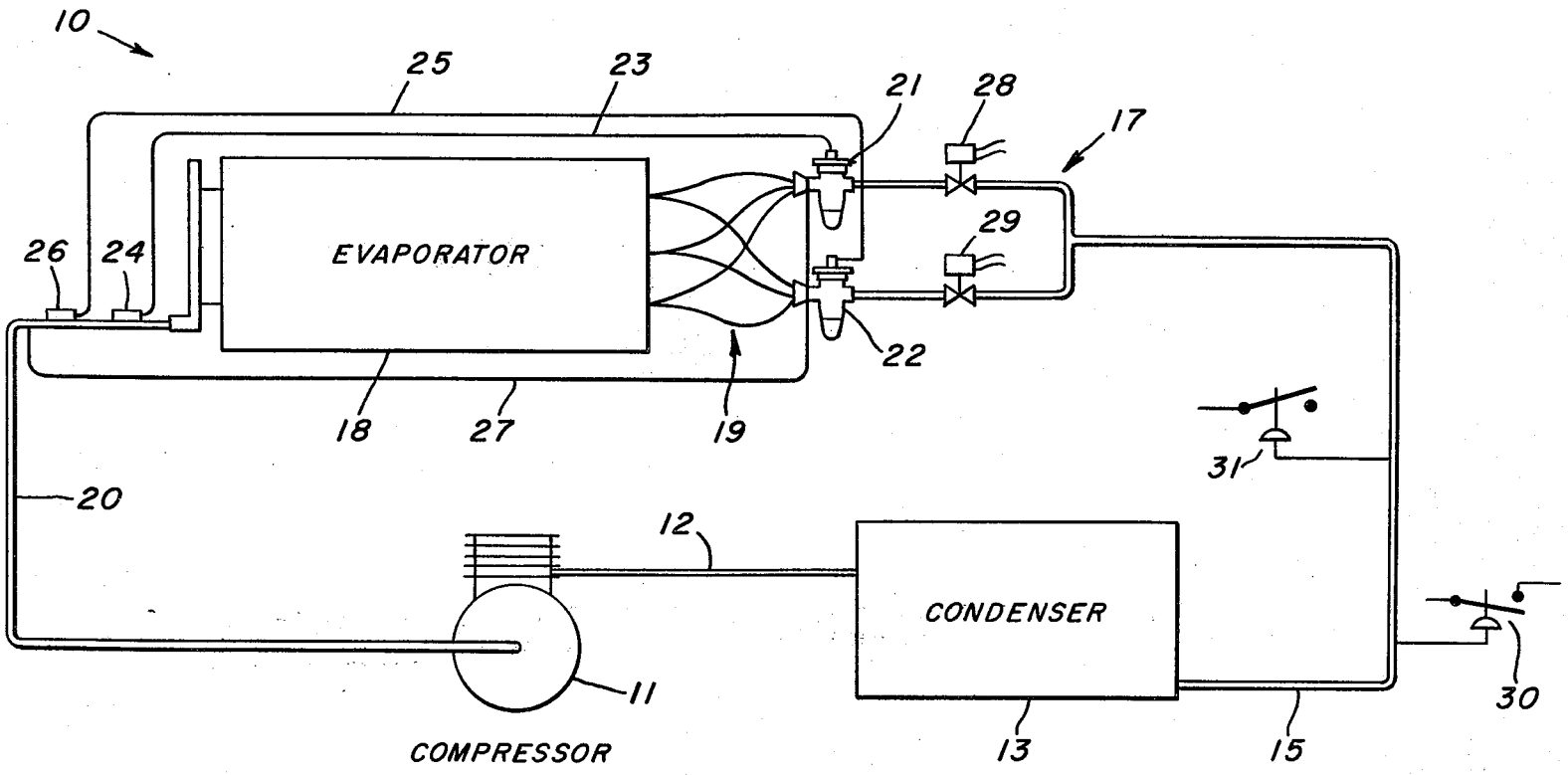
CONDENSER
EVAPORATOR
COMPRESSOR
10
11
12
13
15
17
18
19
20
21
22
23
24
25
26
27
28
29
30
31

REFRIGERANT MASS FLOW CONTROL AT LOW AMBIENT TEMPERATURES

BACKGROUND OF THE INVENTION

In many commercial and industrial applications, refrigeration or air-conditioning systems are continuously operated irrespective of seasonal changes. In, for example, hospitals, laboratories or computer installations which require maintenance of constant temperature and humidity conditions, the heat load on the refrigeration system is substantially the same in summer or winter. In air-cooled refrigeration systems, it is customary to locate the condenser outdoors thus subjecting the condenser to a wide variety of climatic conditions, especially in geographic locations which experience the full range of seasonal changes.

To maintain the cooling capacity of a refrigeration system, it is essential that an adequate pressure differential be maintained across the thermal expansion value to maintain an adequate mass flow of refrigerant through the system. As is well known, the condensing pressure within an air-cooled condenser is a function of outdoor ambient temperature. As outdoor ambient temperature drops, pressure within the condenser also drops while the condensing rate increases resulting in a decrease in the mass flow of refrigerant through the expansion valve due to the decrease in pressure drop across the expansion valve.

The term "condensing pressure" is used synonymously with head pressure or high-side pressure. The "high-side" of a refrigeration system is defined as that part of the system between the discharge side of the compressor and the inlet to the expansion valve. That part of the system between the outlet of the expansion valve and the suction side of the compressor is conventionally referred to as the "low side."

Operating a refrigeration system at too low a high-side pressure can result in serious problems. For example, oil may be trapped in the condenser, the evaporator can be starved due to the insufficient mass flow of refrigerant through the expansion valve and suction gas superheat can reach a point where it cannot dissipate the heat of the compressor, thus causing the compressor to run hot.

A number of solutions to the problem of maintaining an adequate pressure drop across the expansion valve in air-cooled condensers have been proposed. One such proposal is that of controlling the refrigerant flow in response to changes in condensing pressure, sometimes referred to as a "flooded condenser" system. However, this method is quite costly and presents a number of operational difficulties, in that a flooded condenser system requires nearly twice the refrigerant charge as compared to a conventional system. Moreover, the greater the refrigerant charge, the greater the problem of refrigerant migration becomes which can, for example, cause lock-outs of the oil pressure switch and cause damage to the compressor due to "liquid slugging." In addition to the increased size of equipment such as the receiver, an elaborate and costly pressure control system must be provided.

Another means of controlling high-side pressure is termed "air side control," wherein dampers are used to regulate the air flow across the condenser coils. The dampers are operated either in response to condenser pressure or temperature or can be operated by a piston device driven by the discharge pressure of the system.

This type of control also suffers from several limitations and drawbacks. For example, the condenser fans must be of the non-overloading type, for when the dampers are closed, the increased static pressure will cause an increase in the fan motor current. Although this problem could be eliminated by installing a face and by-pass damper arrangement, the same is expensive and occupies too much of the interior space in the condenser. Even so, the dampers are prone to icing under wintry weather conditions and as a result often jam in the open or closed position, either of which could cause serious damage to the system.

It has also been proposed to control high-side pressure via the condenser fan itself. In such systems, a low range reverse-acting high pressure switch is used to sense high-side pressure and is connected to the fan circuit to stop the fan when the head pressure falls below a predetermined point and to start the fan when the head pressure rises to a predetermined point. In a variation of this control means, a modulated speed fan rather than an on-off fan is used, the fan speed decreasing with decreasing high-side pressure and vice-versa. However, there are two major drawbacks to the use of either on-off or variable speed fans. In the first instance, if such controlled fans are used with a horizontal condenser coil, wind velocity can prevent pressure from building up on the high side, thus causing the system to operate at a low head pressure and if the load in the system under such conditions is normal, the superheat at the compressor could increase to a point causing burnout of the compressor. In the second instance the said fan control systems are generally limited in their ability to maintain adequate high-side pressure whenever the outdoor ambient temperature falls below about 50°F.

All of the foregoing proposals are directed to controlling and maintaining adequate head pressure on the high-side of the system in order to assure a sufficient pressure drop across the distribution system so as to provide an adequate mass flow of refrigerant through the expansion valve. It would be desirable to provide a means of assuring adequate mass flow of refrigerant to the evaporator regardless of low pressure condenser conditions caused by low outdoor ambient temperature, thus dispensing with the need for providing sometimes elaborate and costly pressure sensing and fan control means.

OBJECTS OF THE INVENTION

It is, therefore, an object of this invention to provide an improved refrigeration system devoid of the disadvantages of the prior art. It is another object of this invention to provide a means of maintaining an adequate mass flow of refrigerant to the evaporator in refrigeration systems having an air-cooled condenser. It is a further object of this invention to provide a means of maintaining an adequate mass flow of refrigerant to the evaporator at low outdoor ambient temperature conditions. It is an additional object of this invention to provide a means of maintaining an adequate mass flow of refrigerant to the evaporator regardless of low head pressure in the high-side of the system caused by low outdoor ambient temperature.

BRIEF DESCRIPTION OF THE INVENTION

The foregoing objects and others are accomplished in accordance with the invention generally speaking by providing a dual distributor system for supplying refrigerant to the evaporator, refrigerant being metered through only one distributor when the high-side pressure is above a predetermined level and refrigerant being metered through both distributors when the high-side pressure drops below the predetermined level.

DESCRIPTION OF THE DRAWINGS

The invention is illustrated by the attached schematic representation of a typical refrigeration loop embodying the dual distributor system of the invention.

DETAILED DESCRIPTION OF THE INVENTION

In the drawing, a typical refrigeration loop is indicated at 10. The system 10 includes a compressor 11 connected by a hot gas discharge line 12 to a condenser 13. If desired, a receiver (not shown) may be included to collect refrigerant from the condenser 13, the receiver being located in liquid 15 between the condenser and distribution system 17. The refrigerant liquid is passed via liquid line 15 through a dual distributor system 17 to the evaporator 18 via distribution lines 19. In the evaporator 18, the refrigerant liquid is endothermically vaporized and absorbs heat from the surroundings. The heated vapor then passes to the compressor 11 via suction line 20.

The dual distribution system 17 comprises two balanced port thermostatic expansion valves 21 and 22 of conventional type. Valve 21 is provided with a capillary line 23 connecting the valve to a temperature sensing bulb 24 located on suction line 20. In like manner, valve 22 is provided with a capillary line 25 and associated temperature sensing bulb 26. A common external equalizer 27 is also provided for valves 21 and 22. The condenser 13 is of the air-cooled type which is normally situated outdoors and may be remote from the remainder of the system. Cooling of the condenser is effected in known manner by flowing ambient air over the coils by a motor driven fan or the like (not shown).

As beforementioned, as the outdoor ambient temperature drops, the pressure in the condenser also drops and at ambient temperatures below 60°F., this decrease in high-side pressure becomes such that an adequate pressure drop cannot be maintained across the refrigerant metering valve, resulting in a decreased mass flow rate of refrigerant through the metering valve, resulting in evaporator starvation thus upsetting the system, as the gas exiting the evaporator would, due to the decreased mass flow of refrigerant, have too high a superheat, causing the compressor to run too hot, which could cause burn-out of the compressor. According to the invention, an amount of refrigerant sufficient to match the heat load is metered to the evaporator regardless of low head pressure caused by low outdoor ambient temperature.

Under normal operating conditions, i.e., normal highside pressure and outdoor ambient temperature of 60°F. or higher, the system will operate as follows. On a call for cooling, solenoid valve 28 will open allowing refrigerant to flow through expansion valve 21 and into the evaporator 18. The pressure on the low side of the system will rapidly build up and start the compressor 11. As the pressure in the high side of the system builds up, an inverse acting high pressure switch 30 located on liquid line 15 will start the condenser fan when the pressure builds up to a predetermined point. The system will continue to run in this conventional manner so long as the high-side pressure is at or above the predetermined normal operating level.

As the high-side pressure drops below a predetermined level due to decreasing outdoor ambient temperature, the condenser cooling fan shuts off. If the high-side pressure continues to fall, pressure switch 31 closes, opening solenoid valve 29 and refrigerant is metered through expansion valve 22 as well as through expansion valve 21, the latter being previously open as described hereinabove. This parallel flow of refrigerant through both expansion valves 21 and 22 reduces the pressure drop across the dual distributor system 17 by about 75%. As a result, the dual distribution system of the invention can maintain a normal superheat and meter the proper amount of refrigerant into the evaporator to satisfy the heat load at a relatively low high-side pressure caused by low outdoor ambient temperature.

As the outdoor ambient temperature rises with a corresponding rise in high-side pressure and when the high-side pressure attains its normal level, solenoid valve 29 will close, shutting off the flow of refrigerant through expansion valve 22 and refrigerant will be metered only through expansion valve 21 until the high-side pressure again drops below normal levels at which time refrigerant will again be metered through both expansion valves 21 and 22. It will, of course, be realized that the sequence of valve operation may be reversed, i.e., valve 22 may be used to continuously meter refrigerant and valve 21 may be used when high-side pressure drops below its predetermined level as the crux of the invention is that of metering refrigerant through both expansion valves when the high-side pressure is insufficient to provide an adequate pressure drop across the distribution system resulting in insufficient mass flow of refrigerant to the evaporator.

It will, of course, be realized that the predetermined pressure at which refrigerant will be metered through the second distributor will vary somewhat from one refrigeration system to another and will depend, for example, on the capacity of the system, the type of refrigerant used and the like. For example, in a typical industrial refrigeration system, using "Freon-22" as a refrigerant liquid, a high-side pressure of at least about 140 psig to 160 psig will generally suffice to maintain an adequate pressure drop across the expansion valve and assure a sufficient mass flow of refrigerant to the evaporator. However, the determination of the precise pressure below which adequate mass flow of refrigerant cannot be maintained and at which the second distributor will actuate for a given refrigeration system is well within the skill of the art.

Thus the dual distributor system of the invention is capable of ensuring normal evaporator operation at lower ambient temperatures than is possible with conventional systems which rely on maintaining high-side pressure at a sufficiently high level. Moreover, the system is considerably less costly than conventional control systems and eliminates the need for providing elaborate pressure and fan controls. In addition, the system would not require a receiver and requires no more refrigerant than a conventional installation for a low outdoor ambient temperatures, the evaporator can be satisfied with about 25% less refrigerant circulation, due to increased sub-cooling at the low condensing temperature.

What is claimed is:

1. In a refrigeration system comprising a compressor, an air-cooled condenser and an evaporator, all of which are connected in series, including improved means for maintaining an adequate mass flow of refrigerant to the evaporator at below normal high-side pressure, the improvement comprising two parallel refrigerant distributor means located between the condenser and the evaporator, first means associated with the distributor means causing refrigerant to be fed to the evaporator through one of said distributor means when the high-side pressure is at or above a predetermined level and second means associated with the distributor means causing refrigerant to be fed through both of said distributor means when the high-side pressure is below the predetermined level.

2. The improvement of claim 1 wherein each of said distributor means is a thermostatic expansion valve with associated distribution lines.

3. The improvement of claim 2 wherein said first and second means include means for sensing the high-side pressure, said pressure sensing means being in operative communication with said expansion valves whereby refrigerant will be fed through one expansion valve when the high-side pressure, as sensed by said pressure sensing means, is at or above a predetermined level and whereby refrigerant will be fed through both expansion valves when the high-side pressure, as sensed by said pressuring sensing means, is below the predetermined level.

4. The improvement of claim 3 further including a solenoid valve located on the inlet side of each expansion valve.

5. The improvement of claim 4 wherein the pressure sensing means is a pressure responsive switch in operative connection with one of said solenoid valves.

6. In a refrigeration process comprising the steps of evaporating a refrigerant in an evaporator, compressing the refrigerant vapor in a compressor and condensing the refrigerant in an air-cooled compressor, an improved method of maintaining adequate mass flow of refrigerant to the evaporator at below normal high-side pressure comprising the steps of sensing the high-side pressure via pressure sensing means, metering refrigerant to the evaporator through one of two distributor means when the high-side pressure is at or above a predetermined level and metering refrigerant to the evaporator through both distributor means when the high-side pressure is below the predetermined level.

* * * * *